US007121533B2

(12) United States Patent
Warfel et al.

(10) Patent No.: US 7,121,533 B2
(45) Date of Patent: Oct. 17, 2006

(54) AIR FILTER HOUSING WITH TAMPER RESISTANT CARBURETOR FEATURE

(75) Inventors: Paul A. Warfel, Texarkana, TX (US); Rodney W. Tynes, Shreveport, LA (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 216 days.

(21) Appl. No.: 10/854,842

(22) Filed: May 27, 2004

(65) Prior Publication Data

US 2005/0263912 A1 Dec. 1, 2005

(51) Int. Cl.
*F02M 17/34* (2006.01)

(52) U.S. Cl. ..... 261/71; 55/DIG. 28; 123/198 D; 123/198 E; 261/DIG. 84

(58) Field of Classification Search ..... 261/71, 261/DIG. 1, DIG. 38, DIG. 84; 55/385.3, 55/DIG. 28; 123/198 B, 198 D, 198 E
See application file for complete search history.

(56) References Cited

U.S. PATENT DOCUMENTS

| | | | | | |
|---|---|---|---|---|---|
| 1,850,343 | A * | 3/1932 | Donaldson | 55/329 |
| 1,945,180 | A * | 1/1934 | Carter | 261/72.1 |
| 3,194,224 | A * | 7/1965 | Lechtenberg et al. | 261/34.1 |
| 3,796,027 | A * | 3/1974 | Gumtow | 55/502 |
| 4,097,561 | A * | 6/1978 | Seki et al. | 261/41.5 |
| 4,233,043 | A * | 11/1980 | Catterson | 55/315 |
| 4,234,523 | A | 11/1980 | Onuki et al. | 261/41.5 |
| 4,718,828 | A | 1/1988 | Breeck et al. | 417/313 |
| 5,236,634 | A | 8/1993 | Hammett et al. | 261/71 |
| 5,322,645 | A | 6/1994 | Hammett et al. | 261/71 |
| 5,525,267 | A | 6/1996 | Araki | 261/71 |
| 5,688,443 | A | 11/1997 | Swanson | 261/39.3 |
| 5,707,561 | A | 1/1998 | Swanson | 261/71 |
| 5,753,148 | A | 5/1998 | King et al. | 261/71 |
| 5,984,281 | A | 11/1999 | Hacker et al. | 261/71 |
| 6,251,151 | B1 * | 6/2001 | Kobayashi et al. | 55/309 |
| 6,395,049 | B1 * | 5/2002 | Knodler | 55/385.3 |
| 6,402,124 | B1 | 6/2002 | Pattullo et al. | 261/71 |
| 6,446,939 | B1 | 9/2002 | Hoppe et al. | 261/35 |
| 6,467,757 | B1 | 10/2002 | Douyama | 261/71 |
| 6,491,288 | B1 | 12/2002 | Nagata et al. | 261/71 |
| 6,691,988 | B1 * | 2/2004 | Warfel et al. | 261/71 |
| 6,780,214 | B1 * | 8/2004 | Leibold | 55/385.3 |
| 2004/0065965 | A1 * | 4/2004 | Warfel et al. | 261/52 |
| 2005/0224039 | A1 * | 10/2005 | Warfel et al. | 123/198 E |

FOREIGN PATENT DOCUMENTS

| | | | | |
|---|---|---|---|---|
| JP | 53-76214 | * | 7/1978 | 55/DIG. 28 |
| JP | 55-60653 | * | 5/1980 | 55/DIG. 28 |

* cited by examiner

*Primary Examiner*—Richard L. Chiesa
(74) *Attorney, Agent, or Firm*—Pearne & Gordon LLP

(57) ABSTRACT

A device for a power tool that includes an internal combustion engine and a carburetor for supplying an air and fuel mixture to the engine. The carburetor includes at least one externally adjustable component. An air filter arrangement of the device is for in-taking air, filtering the air, and directing the filtered air to the carburetor. The arrangement includes a housing. A tamper-resisting portion of the device extends from the air filter arrangement housing and extends adjacent to the location of the at least one adjustable component. The tamper resisting portion includes a segment that permits access to the at least one adjustable component along a first direction and limits access to the at least one adjustable component off of the first direction.

16 Claims, 3 Drawing Sheets

AIR FILTER HOUSING WITH TAMPER RESISTANT CARBURETOR FEATURE

FIELD OF THE INVENTION

The present invention relates, generally, to smaller, internal combustion engines that have carburetors, and particularly relates to carburetors that are adjustable, e.g., via rotational adjustment of at least one flow metering valve.

BACKGROUND OF THE INVENTION

A portable power tool, such as a chain saw, a hedge trimmer, an edger, or a blower, is often powered by a gasoline engine. Typically, a carburetor is associated with such a smaller engine.

A small engine carburetor has one or more adjustable components, often referred to as needle valves, which control fuel flow. To calibrate fuel flow, each valve is rotationally adjusted to axially extend or retract a valve control surface within a fuel passage in the carburetor until optimum fuel flow through the passage is achieved. Adjustment within the carburetor is commonly done by "metering" during no load or idle engine operation by a first "idle" needle valve and during part or full load operation by a second "main" needle valve. Pre-calibration of the carburetor on a flow test bench may be performed prior to being assembled to an engine. After assembly of the carburetor to an engine, it is customary to adjust the metering valves, if needed, to fine tune fuel flow to the actual demand of the operating engine. Such calibration is first done at an assembly facility, and may subsequently be done by a qualified technician.

Recently, in response to federal and state "clean air" regulations, there has developed an increasing need to prevent gross misadjustment, especially by non-qualified people. Such prevention of gross misadjustment is directed to the prevention of excessive emission of carbon monoxide and unburned hydrocarbons from an internal combustion engine. Thus, subsequent over adjustment of fuel flow is to be prevented/discouraged.

SUMMARY OF THE INVENTION

In accordance with one aspect, the present invention provides a device for a power tool that includes an internal combustion engine and a carburetor for supplying an air and fuel mixture to the engine. The carburetor includes at least one externally adjustable component. The device includes an air filter arrangement for in-taking air, filtering the air, and directing the filtered air to the carburetor. The arrangement includes a housing. The device includes a tamper resisting portion extending from the air filter arrangement housing and extending adjacent to the location of the at least one adjustable component. The tamper resisting portion includes a segment that permits access to the at least one adjustable component along a first direction and limits access to the at least one adjustable component off of the first direction.

In accordance with another aspect, the present invention provides a device for a power tool that includes an internal combustion engine and a carburetor for supplying an air and fuel mixture to the engine. The carburetor includes at least one externally adjustable component. The device includes a housing portion of an air filter arrangement that is for in-taking air, filtering the air, and directing the filtered air to the carburetor. The housing portion is configured to at least partially enclose an air filter of the air filter arrangement. A tamper-resisting portion extends from the housing portion and extends adjacent to the location of the at least one adjustable component. The tamper resisting portion includes a segment that permits access to the at least one adjustable component along a first direction and limits access to the at least one adjustable component off of the first direction.

BRIEF DESCRIPTION OF THE DRAWINGS

The foregoing and other features and advantages of the present invention will be apparent from the description below with reference to the drawings wherein.

DESCRIPTION OF AN EXAMPLE EMBODIMENT

Figure 1:
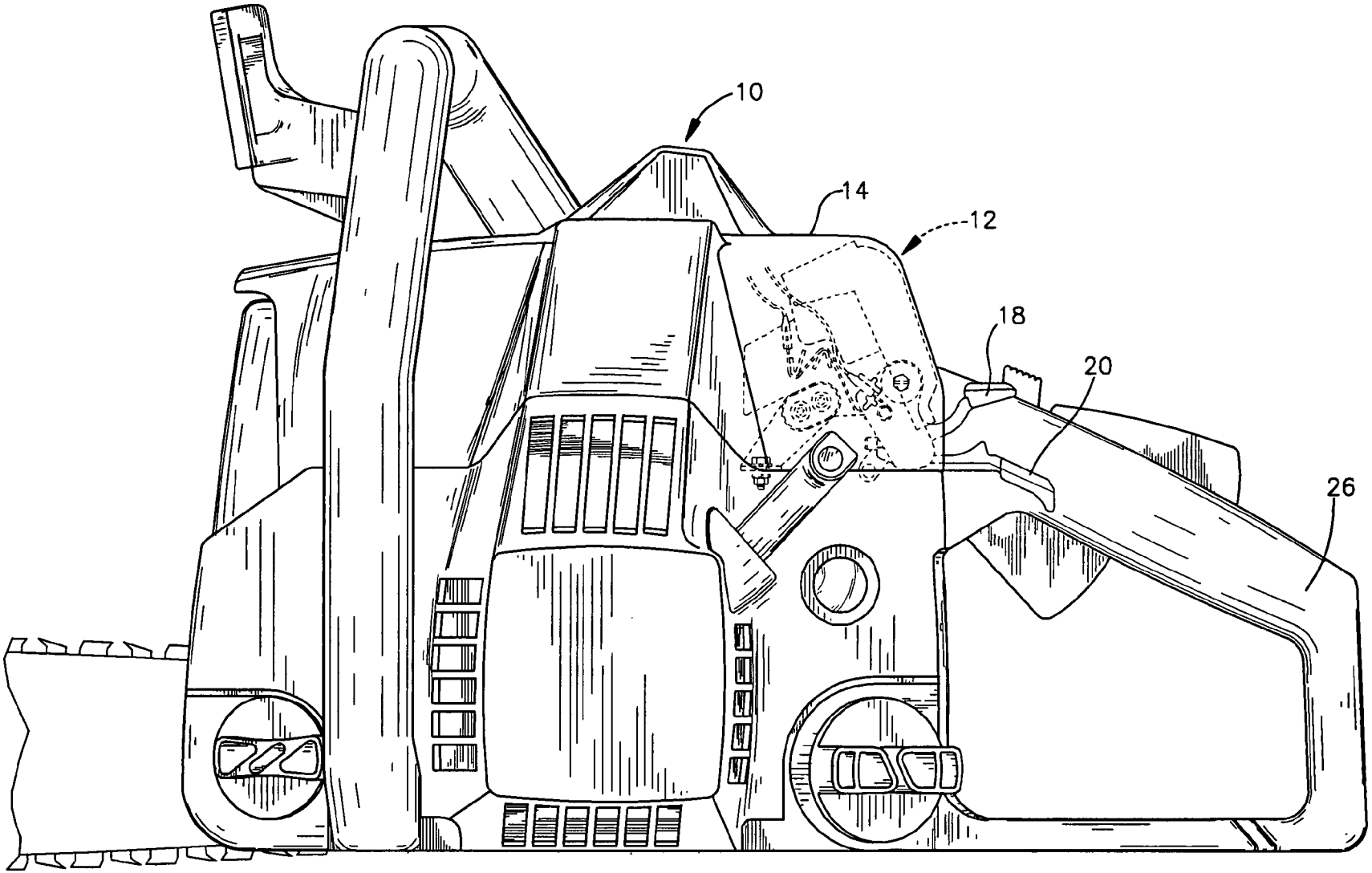
FIG. 1 is a side view of an example chain saw incorporating one example embodiment of the present invention.
Figure 2:
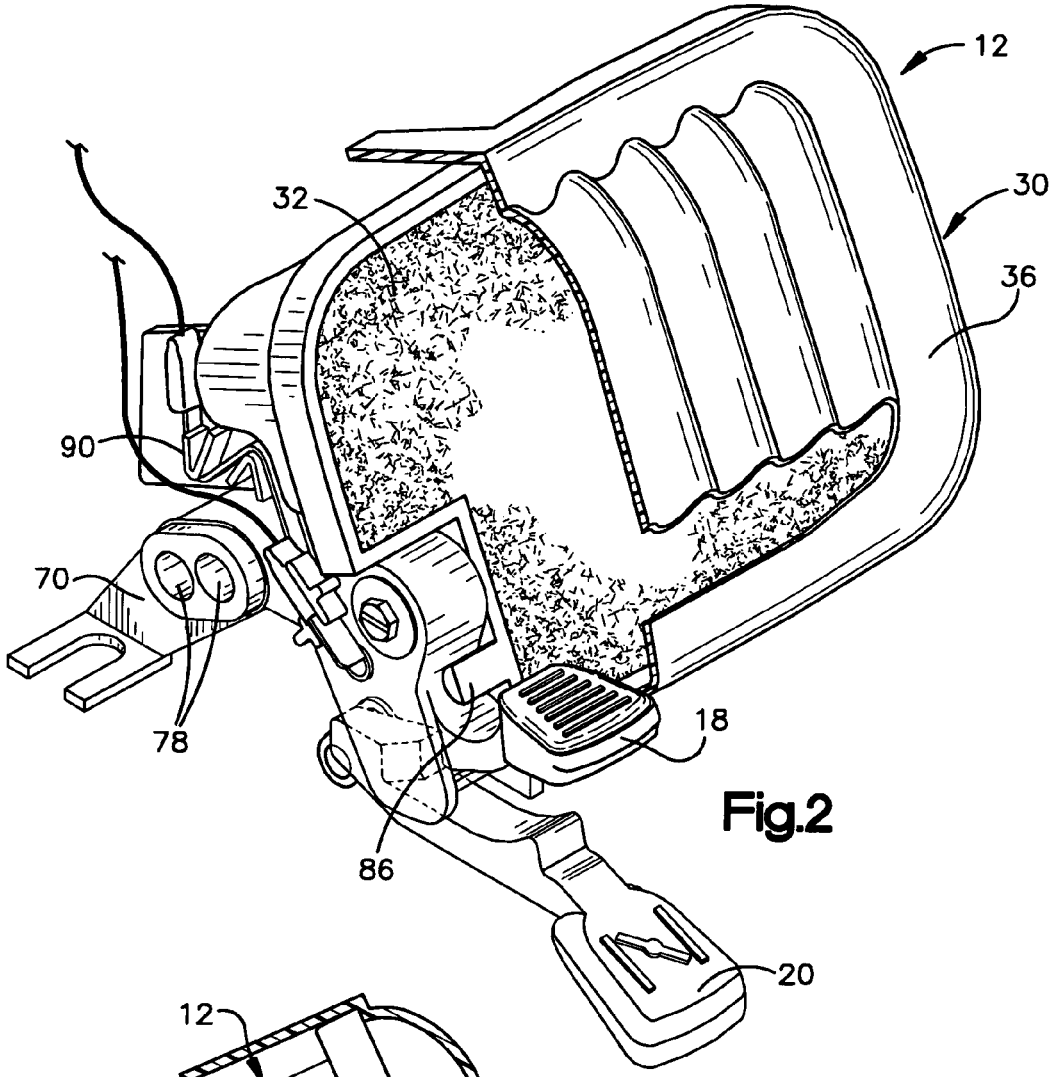
FIG. 2 is a perspective view of a portion of the chain saw of FIG. 1 that includes the example embodiment of the present invention.
Figure 4:
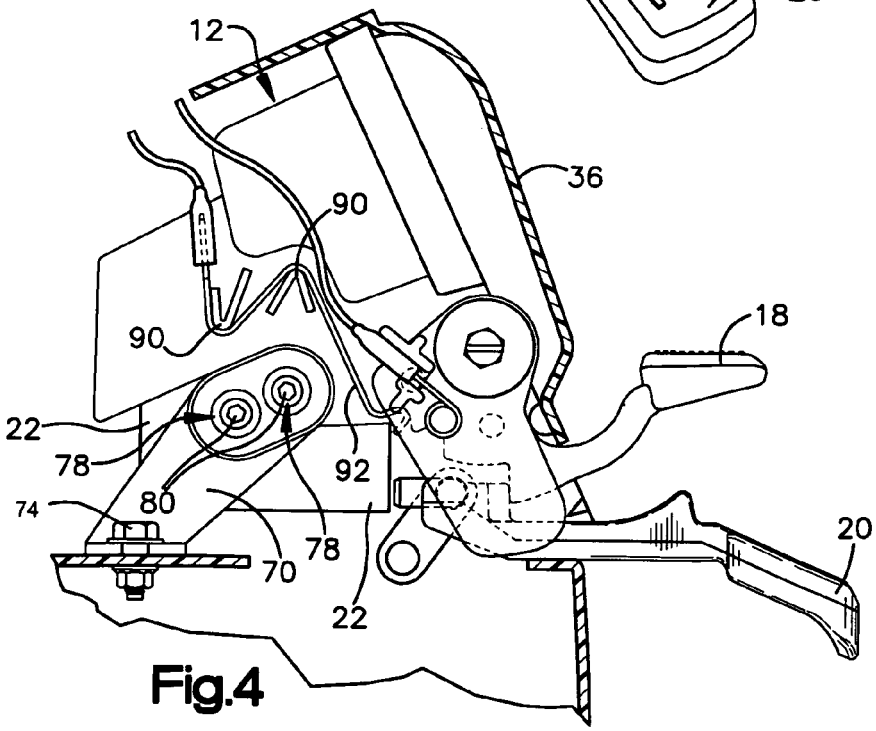
FIG. 4 is a side view of the portion shown if FIG. 2.
Figure 3:
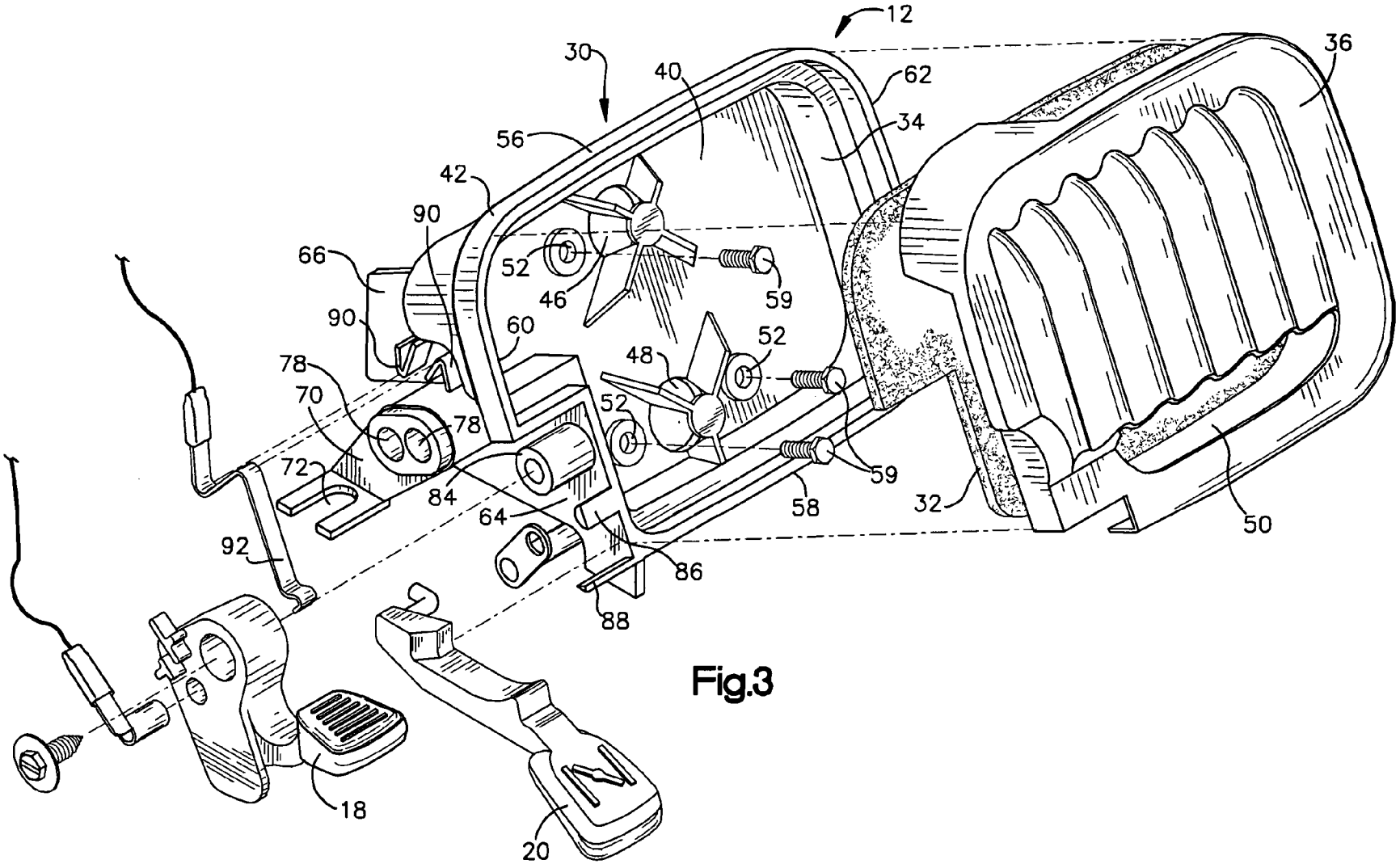
FIG. 3 is an exploded view of the portion shown in FIG. 2.

An example chain saw 10 that has an example air filter arrangement 12 for helping to prevent carburetor tampering in accordance with the present invention is shown in FIG. 1. Although the present invention is described in connection with a chain saw 10 it is to be appreciated that the present invention may be utilized with other types of power tools, including portable power tools such as, for example, hedge trimmers, edgers, and blowers. As shown in FIG. 1, the structures associated with the present invention and in the general vicinity of the present invention are located within the confines of an outer cover 14 of the chain saw 10. FIGS. 2–4 focus on these structures that are within the outer cover 14 (cover removed in FIG. 2–4).

In general, the structures at the area of the invention include an ignition system switch lever 18, a choke system mechanism lever 20, a carburetor 22 (schematically shown in FIG. 4), and the air filter arrangement 12. It is to be appreciated that the chain saw 10, or other power tool incorporating the present invention, has other components that need not be discussed herein. As mentioned above, it is a portion of the filter unit that is specialized to provide the example of the present invention.

The levers 18 and 20 are provided to enable the operator of the chain saw 10 to readily manipulate an ignition switch and a choke mechanism, respectively, and both levers are positioned near a handle 26 (see FIG. 1) of the chain saw for easy access by the operator.

The air filter arrangement 12 is best described with reference to FIGS. 2 and 3 of the drawings. As illustrated in these figures, the air filter arrangement 12 includes a filter housing 30 and a filter 32 disposed within the housing. The filter housing 30 includes a filter housing base 34 and a filter housing cover 36. The filter housing base 34 and the cover 36 can be made of any of a variety of suitable materials such as, for example, metals, heat-resistant composites or plastics. In the presently described embodiment, the filter housing base 34 and the cover 36 are made of a hardened plastic and are configured so that the cover can be both snapped tightly onto the housing base and unsnapped from the housing base in a manner that will be understood by those having ordinary skill in the art.

The filter housing base 34 includes a base floor 40 and a perimeter wall 42. The base floor 40 includes ports 46 and 48 that are in fluid communication with inlet ports in the carburetor 22 (see FIG. 4) as will be appreciated by the person of ordinary skill in the art. Air enters the filter housing through an opening 50 in the cover 36, passes through the filter 32, and is drawn into the carburetor 22 through the ports 46 and 48. Air entering the carburetor 22 through port 48 mixes with fuel injected into the carburetor and the air-fuel mixture is delivered to the chain saw's engine where combustion of the fuel takes place. Air entering the carburetor 22 through port 46 is not to be mixed with fuel and is, simply, directed to the engine where it contributes to the combustion of the air-fuel mixture delivered to the engine. The arrangement of the carburetor 22 with the engine and the manner in which the engine otherwise operates are, essentially, independent of the present invention and, consequently, are not described here. Various methods and designs for performing these functions will be appreciated by the person of ordinary skilled in the art.

The base floor 40 also is provided with several openings 52 into which threaded portions of fasteners 59 extend. The fasteners 59 are screwed into complementary threaded holes (not visible) in the carburetor 22, and this arrangement constitutes the means by which the filter housing base 34 is attached to the carburetor.

The perimeter wall 42 is integral with the base floor 40 and extends, generally, perpendicularly from the perimeter of the housing base floor in the direction of the cover 36. As is best seen in FIG. 3, the perimeter wall 42 has an inside surface and an outside surface with the inside surface of the perimeter wall and the base floor 40 defining a housing base interior.

The perimeter wall 42 includes an anterior section 56, a posterior section 58, a first lateral section 60, and a second lateral section 62. The first lateral section 60 joins one terminus of the anterior section 56 to one terminus of the posterior section 58, and the second lateral section 62 joins the other terminus of the anterior section to the other terminus of the posterior section. Consequently, when installed in the chain saw 10, the anterior section 56 is nearest the front of the chain saw, the posterior section 58 is nearest the rear of the chain saw and the first and second lateral sections 60, 62 are disposed toward opposite sides of the chain saw.

In the embodiment shown in the drawings, a portion 64 of the first lateral section 60 of the perimeter wall 42 that is adjacent the posterior section 58 of the perimeter wall is recessed inwardly toward the housing base interior. Integral with the first lateral section 60 of the perimeter wall 42 is an augmentation, or extension, 66 that extends in a direction perpendicular to the extent of the base floor 40. Further, the augmentation 66 and the recessed portion 64 of the first lateral section of the housing base perimeter wall are located in substantially the same plane as can best be seen in FIGS. 2 and 3. Although the shown embodiment includes the recessed portion 64 on the first lateral section 60 of the housing base perimeter wall, it is not essential that the first lateral section be recessed.

The air filter arrangement 12 additionally includes first and second opposed support legs (only one visible, 70) that are positioned on the housing base 34. The first support leg 70, as shown in FIGS. 2 and 3, is integral with the augmentation 66. The second support leg is structurally, essentially, the same as the first support leg 70, and is integral with the second lateral section 62 of the housing base perimeter wall and is located opposite to the location of the first support leg 70. At the end of each support leg is a foot portion that has a slot or opening 72. The opposed support legs secure the filter housing base 34 to the chassis of the chain saw, with the cooperation of suitable fasteners 74, as shown in FIG. 4 and, thus, comprise a means on the filter housing by which the housing may be secured to the chain saw.

In accordance with the present invention, the shown example has a pair of openings 78 that extend through the first support leg 70 and the augmentation 66 with which the leg is integral. The openings 78 are aligned with carburetor adjustment needles 80 and, thus, provide access holes to the needles for the purpose of adjusting the carburetor. However, it is to be appreciated that the access is somewhat limited. Specifically, access is only permitted along the axis of each opening 78 (i.e., a first direction). As such, the first support leg 70 with the openings 78 inhibits access to each adjustment needle 80 along directions other than the respective axial direction (i.e., off of the first direction). As such, a level of difficulty is provided against an unauthorized person that tries to engage the adjustment needles with some other type of tool, such as pliers. Also, in one example, each of the adjustment needles 80 includes an engagement portion (i.e., a head, visible in FIG. 4) that is configured to mate with corresponding portion on an adjustment tool (not shown). In one example, the mating portions (i.e., needle head and tool) are specially configured. Further in one example, configuration of the mating portions is of limited availability (e.g., not commonly available), and intended to be of limited availability to manufacturing and authorized servicing personnel. Examples of some common mating configurations include slotted or phillips type screwdriver configurations. As such, in the example, the matting configuration is something other than slotted or phillips type screwdriver configurations, such as specially shaped matting portions.

It is to be appreciated that the filter housing 30 may be otherwise utilized, configured, etc., without effect to provision of the present invention. Within the shown example, the filter housing base 34 also includes a mounting element 84 on which the ignition system switch lever 18 is mounted. In the shown example, the ignition system switch lever is mounted for pivotal movement. As such, the mounting element is a cylindrical projection that mates with an opening on the ignition system switch lever 18. In the shown example, the mounting element 84 is located on the recessed portion 64 of the first lateral section 60 of the perimeter wall 42. Specifically, the mounting element 84 is integral with the outside surface of the first lateral section 60 of the perimeter wall 42. A hole may extend into the mounting element 84 in order to receive a member (e.g., a screw accompanied by a washer) that retains the ignition system switch lever 18 on the mounting element.

Further within the shown example, to assist in preventing the ignition system switch lever 18 from proceeding in its pivotal movement beyond an "ON" position, a stop lug 86 is provided on the filter housing base 34 at a location adjacent to the mounting element 84. The filter housing base 34 also includes a guide lug 88 at a location that is adjacent to the stop lug 86 for providing a guiding surface for the choke system mechanism lever 20. The person of ordinary skill will appreciate that the choke system mechanism lever 20 interacts with addition structure (e.g., a valve lever that has an arm, as shown in FIGS. 2–4).

Also included on the filter housing is a pair of positioning elements 90 located, generally, adjacent the mounting element 84. In the shown example, the positioning elements are integral with the augmentation 66 and are located forwardly of the mounting element 84. The positioning elements 90 provide a mounting location for an S-shaped leaf spring 92 of an ignition circuit (partially shown, see electrical leads within FIG. 3). The ignition system switch lever 18 interacts with the leaf spring 92 to control engine ignition, as will be appreciated by the person of ordinary skill in the art.

While an example embodiment of the invention has been shown and described herein, it is to be understood that the invention is not so limited but covers and includes any and all modifications and variations that are encompassed by the following claims.

What is claimed is:

1. A device for a power tool that includes an internal combustion engine and a carburetor for supplying an air and fuel mixture to the engine, the carburetor including at least one externally adjustable component, the device including:

an air filter arrangement for in-taking air, filtering the air, and directing the filtered air to the carburetor, the arrangement including a housing; and a tamper-resisting portion extending from the air filter arrangement housing and extending adjacent to the location of the at least one adjustable component, the tamper resisting portion including a segment that permits access to the at least one adjustable component along a first direction and limits access to the at least one adjustable component off of the first direction.

2. A device as set forth in claim 1, wherein the tamper resisting portion is part of a support leg of the housing, and the support leg includes a portion for securing engagement with a portion of the power tool.

3. A device as set forth in claim 1, wherein the segment of the tamper resisting portion that permits access includes at least one opening through the tamper resisting portion.

4. A device as set forth in claim 3, wherein the opening is aligned with the at least one adjustable component along the first direction.

5. A device as set forth in claim 3, wherein the carburetor includes two externally adjustable components, the segment of the tamper resisting portion that permits access includes two openings through the tamper resisting portion, and each opening is aligned with a respective adjustable component.

6. A device as set forth in claim 1, wherein the housing of the air filter arrangement and the tamper-resisting portion are integrally formed.

7. A device as set forth in claim 6, wherein the housing of the air filter arrangement and the tamper-resisting portion are formed of a plastic material.

8. A device for a power tool that includes an internal combustion engine and a carburetor for supplying an air and fuel mixture to the engine, the carburetor including at least one externally adjustable component, the device including:

a housing portion of an air filter arrangement that is for in-taking air, filtering the air, and directing the filtered air to the carburetor, the housing portion being configured to at least partially enclose an air filter of the air filter arrangement; and a tamper-resisting portion extending from the housing portion and extending adjacent to the location of the at least one adjustable component, the tamper resisting portion including a segment that permits access to the at least one adjustable component along a first direction and limits access to the at least one adjustable component off of the first direction.

9. A device as set forth in claim 8, wherein the tamper resisting portion is part of a support leg of the housing, and the support leg includes a portion for securing engagement with a portion of the power tool.

10. A device as set forth in claim 8, wherein the segment of the tamper-resisting portion that permits access includes at least one opening through the tamper-resisting portion.

11. A device as set forth in claim 10, wherein the opening is aligned with the at least one adjustable component along the first direction.

12. A device as set forth in claim 10, wherein the carburetor includes two externally adjustable components, the segment of the tamper resisting portion that permits access includes two openings through the tamper resisting portion, and each opening is aligned with a respective adjustable component.

13. A device as set forth in claim 8, wherein the housing of the air filter arrangement and the tamper-resisting portion are integrally formed.

14. A device as set forth in claim 13, wherein the housing of the air filter arrangement and the tamper-resisting portion are formed of a plastic material.

15. An integrally formed device including a first portion that is part of a housing of an air filter arrangement for a power tool, which includes an internal combustion engine and a carburetor supplying an air and fuel mixture to the engine, wherein the carburetor includes at least one externally adjustable component, and being configured to at least partially enclose an air filter of the air filter arrangement, and a second portion extending from the first portion and adjacent to the location of the at least one adjustable component to provide tamper-resistance.

16. A device as set forth in claim 15, wherein the second portion includes a segment that permits access to the at least one adjustable component along a first direction and limits access to the at least one adjustable component off of the first direction.

* * * * *